US007956018B2

(12) United States Patent
McGeehan

(10) Patent No.: US 7,956,018 B2
(45) Date of Patent: Jun. 7, 2011

(54) LUBRICANT COMPOSITION

(75) Inventor: James A. McGeehan, San Rafael, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 382 days.

(21) Appl. No.: 12/000,183

(22) Filed: Dec. 10, 2007

(65) Prior Publication Data

US 2009/0149357 A1 Jun. 11, 2009

(51) Int. Cl.
*C10M 105/04* (2006.01)

(52) U.S. Cl. ..... 508/110; 208/18; 208/19; 208/24

(58) Field of Classification Search ..... 508/110; 208/18; 585/1

See application file for complete search history.

(56) References Cited

U.S. PATENT DOCUMENTS

| | | | | |
|---|---|---|---|---|
| 3,773,650 | A | 11/1973 | Hislop et al. | |
| 3,775,288 | A | 11/1973 | Eagen et al. | |
| 3,852,207 | A | 12/1974 | Stangeland et al. | |
| 4,440,871 | A | 4/1984 | Lok et al. | |
| 4,477,333 | A | 10/1984 | Hafez | |
| 4,673,487 | A | 6/1987 | Miller | |
| 4,943,424 | A | 7/1990 | Miller | |
| 4,943,672 | A | 7/1990 | Hamner et al. | |
| 5,059,299 | A | 10/1991 | Cody et al. | |
| 5,135,638 | A | 8/1992 | Miller | |
| 5,158,665 | A | 10/1992 | Miller | |
| 5,282,958 | A | 2/1994 | Santilli et al. | |
| 5,348,982 | A | 9/1994 | Herbolzheimer et al. | |
| 5,733,839 | A | 3/1998 | Espinoza et al. | |
| 6,090,989 | A * | 7/2000 | Trewella et al. | 585/13 |
| 7,018,525 | B2 | 3/2006 | Miller et al. | |
| RE39,073 | E | 4/2006 | Herbolzheimer et al. | |
| 7,067,049 | B1 * | 6/2006 | Baillargeon et al. | 208/18 |
| 7,195,706 | B2 | 3/2007 | Abernathy | |
| 7,282,134 | B2 | 10/2007 | Abernathy et al. | |
| 2004/0077505 | A1 * | 4/2004 | Daniel et al. | 508/110 |
| 2004/0129603 | A1 | 7/2004 | Fyfe | |
| 2005/0077208 | A1 | 4/2005 | Miller et al. | |
| 2005/0077209 | A1 | 4/2005 | Miller et al. | |
| 2005/0133409 | A1 | 6/2005 | Abernathy et al. | |

(Continued)

FOREIGN PATENT DOCUMENTS

EP B 450860 10/1994

(Continued)

OTHER PUBLICATIONS

Barrer, R.M., *Zeolite Structures Zeolites, Science and Technology*, pp. 75—edited by F.R. Rodriques, L.D. Rollman and C. Naccace, NATO ASI Series 1984.

(Continued)

*Primary Examiner* — Ellen M McAvoy
*Assistant Examiner* — Pamela Weiss
(74) *Attorney, Agent, or Firm* — Merchant & Gould

(57) ABSTRACT

A lubricant composition includes a base oil having a consecutive number of carbon atoms and a viscosity index greater than a Viscosity Index Factor calculated by the following equation:

$$28 \times Ln(\text{Kinematic Viscosity at } 100^\circ \text{ C.}) + 95.$$

The lubricant composition also includes greater than 15 weight % detergent inhibitor (DI) additive package. The lubricant composition has a dynamic viscosity at −35° C. of less than 6200 mPa·s, a Mini-Rotary Viscosity (MRV) at −40° C. of less than 60,000 mPa·s, and a Cold Cranking Simulator (CCS) Viscosity at −35° C. of less than 6200 mPa·s.

20 Claims, 2 Drawing Sheets

U.S. PATENT DOCUMENTS

| | | | | |
|---|---|---|---|---|
| 2005/0227866 | A1 | 10/2005 | Berge et al. | |
| 2006/0183651 | A1* | 8/2006 | Wedlock | 508/469 |
| 2006/0196807 | A1 | 9/2006 | Rosenbaum et al. | |
| 2006/0201852 | A1* | 9/2006 | Rosenbaum et al. | 208/19 |
| 2006/0205610 | A1* | 9/2006 | Rosenbaum et al. | 508/110 |
| 2006/0289337 | A1 | 12/2006 | Rosenbaum et al. | |
| 2007/0238628 | A1* | 10/2007 | Haire et al. | 508/591 |
| 2008/0083657 | A1 | 4/2008 | Zones et al. | |

FOREIGN PATENT DOCUMENTS

| | | |
|---|---|---|
| EP | A 668342 | 2/1995 |
| EP | A 776959 | 6/1997 |
| WO | WO A 9920720 | 4/1999 |
| WO | WO A 9934917 | 7/1999 |
| WO | WO 2004/033606 A1 | 4/2004 |
| WO | WO A 2004081157 | 9/2004 |
| WO | WO A 2005107935 | 11/2005 |

OTHER PUBLICATIONS

Baerlocher, Ch., et al. *Atlas of Zeolite Framework Types*, Fifth Revised Ed., Elsevier, pp. 10-15 2001.

Breck, *Zeolite Molecular Sieves*, Chapter 8, pp. 593-724, John Wiley & Sons, New York, 1974.

Anderson et al, "Reactions on ZSM-5-Type Zeolite Catalysts", J. Catalysis 58:114-130 (1979).

Gruse, W., and Stevens, *Chemical Technology of Petroleum*, 3rd Ed., McGraw-Hill Book Company, Inc., NY 556-570 (1960).

Kramer, D.C., "Influence of Group II & III Base Oil Composition on viscosity index and Oxidation Stability", NLGI vol. 63, No. 10, pp. 20-34 (1999).

International Preliminary Report from PCT/US2008/083900, mailed Jun. 24, 2010, 6 pages.

* cited by examiner

LUBRICANT COMPOSITION

FIELD OF ART

Provided are lubricant compositions suitable for use as multigrade heavy duty motor oil (HDMO), for example, SAE 0W-30 multigrade HDMO. In an embodiment, the lubricant composition includes Fisher-Tropsch derived lubricant base oil.

BACKGROUND

Lubricant compositions and greases used for various applications, including automobiles, diesel engines, natural gas engines, axles, transmissions, and industrial applications consist of two general components, base oil and additives. Base oil is the major constituent in these lubricant compositions and contributes significantly to the properties of the lubricant compositions. In general, a few base oils are used to manufacture a wide variety of lubricant compositions by varying the mixtures of individual base oils and individual additives.

Numerous governing organizations, including original equipment manufacturers (OEMs), the American Petroleum Institute (API), Association des Consructeurs d'Automobiles (ACEA), the American Society of Testing and Materials (ASTM), the Society of Automotive Engineers (SAE), and National Lubricating Grease Institute (NLGI) among others, define the specifications for base oils and lubricant compositions.

The fuel economy of vehicles produced and sold in the United States is regulated by federal agencies. One strategy auto makers use to try to improve the fuel economy of their vehicle is to use fuel-efficient engine lubricants in their vehicles. Fuel efficiency improvements in engine lubricants have been achieved by adding friction modifiers to reduce friction among moving engine parts or, alternatively, by using a lower viscosity grade engine lubricant to minimize energy loss.

Synthetic SAE 0W-30 HDMOs give better fuel economy than oils formulated to higher viscosity grades, such as, for example, SAE 15W-40. Synthetic SAE 0W-30 HDMOs are used in regions that experience extremely cold weather conditions. Synthetic SAE 0W-30 HDMOs are typically formulated with expensive synthetic basestocks, such as polyalphaolefins (PAOs) and esters, to produce desired low temperature properties. What is desired are lubricant compositions having acceptable low temperature properties, which do not require inclusion of expensive synthetic basestocks, such as polyalphaolefins (PAOs) and esters, and which exhibit fuel economy improvements.

SUMMARY

Provided is a lubricant composition comprising a base oil, which comprises a consecutive number of carbon atoms and has a viscosity index greater than a Viscosity Index Factor calculated by the following equation:

$$28\times\text{Ln}(\text{Kinematic Viscosity at } 100^\circ\text{ C.})+95.$$

The lubricant composition also comprises greater than 15 weight % detergent inhibitor (DI) additive package. In an embodiment, the lubricant composition comprises less than 25 weight %, for example, less than 20 weight %, detergent inhibitor (DI) additive package. The lubricant composition has a dynamic viscosity at −35° C. of less than 6200 mPa·s, a Mini-Rotary Viscosity (MRV) at −40° C. of less than 60,000 mPa·s, and a Cold Cranking Simulator (CCS) Viscosity at −35° C. of less than 6200 mPa·s.

Also provided is a process for forming a lubricant composition, the process comprising obtaining a base oil comprising a consecutive number of carbon atoms and has a viscosity index greater than a Viscosity Index Factor calculated by the following equation:

$$28\times\text{Ln}(\text{Kinematic Viscosity at } 100^\circ\text{ C.})+95;$$

and mixing the base oil with greater than 15 weight % detergent inhibitor (DI) additive package. The lubricant composition has a dynamic viscosity at −35° C. of less than 6200 mPa·s, a Mini-Rotary Viscosity (MRV) at −40° C. of less than 60,000 mPa·s, and a Cold Cranking Simulator (CCS) Viscosity at −35° C. of less than 6200 mPa·s.

DETAILED DESCRIPTION

Figure 1:
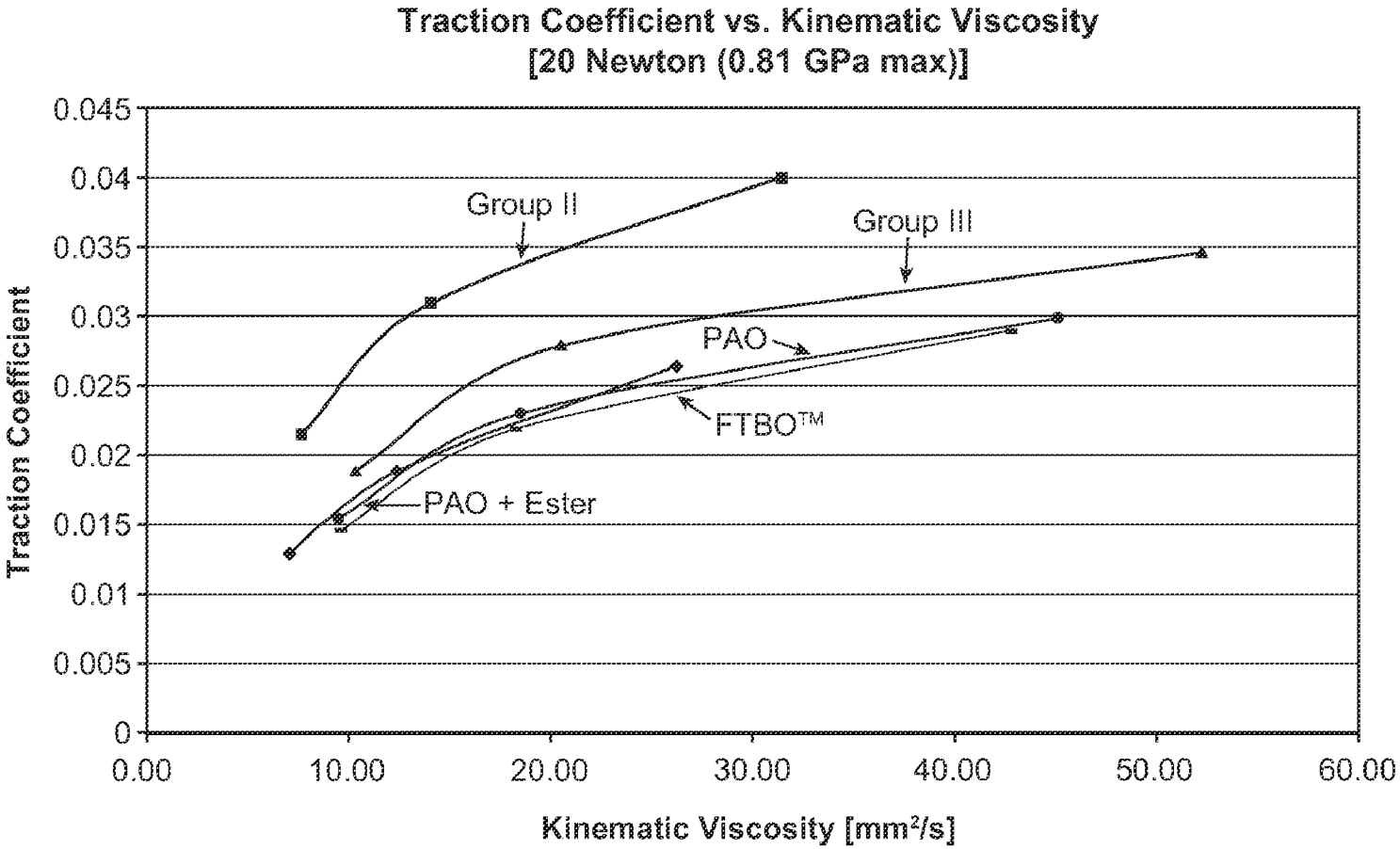
FIGS. 1 and 2 are graphs presenting traction coefficient data for various tested lubricant compositions.

It has been surprisingly discovered that a base oil comprising a consecutive number of carbon atoms can be used to produce a lubricant composition that meets the viscometric requirements of an SAE 0W-30, which, according to SAE J300, revised 2004, are presented in Table 1.

TABLE 1

| SAE Viscosity Grade | Low-Temperature Cranking Viscosity @ −35° C. (mPa · s) | Low-Temperature Pumping Viscosity @ −40° C. (mPa · s) | Low-Shear-Rate Kinematic Viscosity @ 100° C. ($mm^2/s$) | High-Shear-Rate Viscosity @ 150° C. and $10^6\ s^{-1}$ (mPa · s) |
|---|---|---|---|---|
| 0W-30 | ≦6,200 | ≦60,000 with no yield stress | ≧9.3 and <12.5 | ≧2.9 |

In an embodiment, the base oil comprising a consecutive number of carbon atoms is a low viscosity Fisher-Tropsch derived lubricant base oil having a high viscosity index (VI). Despite the inclusion of a significant amount of additives in the present compositions (specifically, a DI additive package formulated for heavy duty motor oils), which can adversely affect low temperature properties, good low temperature properties of the Fisher-Tropsch derived lubricant base oil (i.e., low CCS Viscosity and low MRV) are exhibited in the lubricant composition. Using a significant amount of DI package provides more robust amounts of additives which enables the lubricant composition to hold up under more severe driving conditions and for longer periods of use between drains. As disclosed herein, the present compositions can contain a significant amount of DI package and retain good low temperature properties.

It has been further discovered that the lubricant compositions containing Fisher-Tropsch derived lubricant base oil disclosed herein are substantially more fuel-efficient than lubricant compositions containing conventional Group III or Group II basestocks. Specifically, lubricant compositions containing Fisher-Tropsch derived lubricant base oil demonstrated lower traction coefficient when compared with lubricant compositions containing conventional Group III or Group II basestocks.

PAO Oils

As described herein, the present base oil comprises a consecutive number of carbon atoms. In contrast to the present base oil, PAO oils are an oligomerization product of even carbon numbered linear alpha olefins, typically 1-decene. The PAO oil molecules, therefore, comprise a mixture of even carbon numbered hydrocarbon molecules, differing from each other in the number of carbon atoms, by multiples of the number of carbon atoms in the linear alpha olefin starting monomer. Even if a mixture of linear alpha olefin monomers having even numbers of carbon atoms (e.g., decene and dodecene) were oligomerized to form a heavy lubricant base stock oil, the number of carbon atoms in the resulting hydrocarbon molecules would still have even numbers of carbon atoms. This characteristic is different from the mixture of consecutive numbers of carbon atoms in the hydrocarbon molecules of the base oil of the lubricant composition, which comprise hydrocarbon molecules having both even and odd numbers of carbon atoms and which differ from each other by consecutive numbers of carbon atoms (e.g., 1, 2, 3, 4, 5, 6, 7 and more carbon atoms).

That hydrocarbon molecules of the base oil of the lubricant composition differ from each other by consecutive numbers of carbon atoms is a consequence of the waxy feed also having sequential numbers of carbon atoms. Any products made from a waxy feed having a broad boiling range have sequential numbers of carbon atoms, which primarily distinguishes over PAOs and other synthetics that are not made by hydroisomerization of waxy feeds.

For example, in the Fischer-Tropsch hydrocarbon synthesis reaction the source of carbon atoms is CO and the hydrocarbon molecules are built up one carbon atom at a time. Petroleum-derived waxy feeds also have sequential numbers of carbon numbers. In contrast to an oil based on PAO, the molecules of the base oil of the lubricant composition have a more linear structure, comprising a relatively long backbone with short branches. The classic textbook description of a PAO is a star-shaped molecule, and in particular tridecane, which is illustrated as three decane molecules attached at a central point. While a star-shaped molecule is theoretical, nevertheless PAO molecules have fewer and longer branches than the hydrocarbon molecules that make up the base oil of the present lubricant composition.

Fischer-Tropsch Derived Base Oils

As discussed herein, Fischer-Tropsch hydrocarbon synthesis is one source of the lubricant base oil to be used in the present lubricant compositions. Fischer-Tropsch derived base oils produced by catalytic hydroisomerization have excellent oxidation stability, low volatility, and high viscosity index. Fischer-Tropsch derived base oils contain greater than 95 weight % or greater than 99.0 weight %, or greater than 99.5 weight % saturates, which in addition distinguishes them from most hydrocracked base oils used previously in lubricant compositions. Because of their good properties, Fischer-Tropsch derived base oils can be blended into lubricant compositions. In an embodiment, Fischer-Tropsch derived base oils have inherently good lubricant characteristics, due to their content of molecules with cycloparaffinic functionality, and therefore have natural lubricity, wear resistance, solvency and seal compatibility. Fischer-Tropsch derived base oils also are fully compatible with naphthenic and solvent neutral base oils, and when combined with other types of base oils make a base oil blend that is further enhanced in the aforementioned lubricant characteristics.

Definitions and Terms

The following terms will be used throughout the specification and will have the following meanings unless otherwise indicated.

The term "Fischer-Tropsch derived" means that the product, fraction, or feed originates from or is produced at some stage by a Fischer-Tropsch process.

The term "petroleum derived" means that the product, fraction, or feed originates from the vapor overhead streams from distilling petroleum crude and the residual fuels that are the non-vaporizable remaining portion. A source of the petroleum derived product, fraction, or feed can be from a gas field condensate.

Highly paraffinic wax means a wax having a high content of n-paraffins, generally greater than 40 weight %, but can be greater than 50 weight %, or even greater than 75 weight %, and less than 100 weight % or 99 weight %. Examples of highly paraffinic waxes include slack waxes, deoiled slack waxes, refined foots oils, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof.

The term "derived from highly paraffinic wax" means that the product, fraction, or feed originates from or is produced at some stage by from a highly paraffinic wax.

Aromatics means any hydrocarbonaceous compounds that contain at least one group of atoms that share an uninterrupted cloud of delocalized electrons, where the number of delocalized electrons in the group of atoms corresponds to a solution to the Huckel rule of 4n+2 (e.g., n=1 for 6 electrons, etc.). Representative examples include, but are not limited to, benzene, biphenyl, naphthalene, and the like.

Molecules with cycloparaffinic functionality mean any molecule that is, or contains as one or more substituents, a monocyclic or a fused multicyclic saturated hydrocarbon group. The cycloparaffinic group can be optionally substituted with one or more, such as one to three, substituents. Representative examples include, but are not limited to, cyclopropyl, cyclobutyl, cyclohexyl, cyclopentyl, cycloheptyl, decahydronaphthalene, octahydropentalene, (pentadecan-6-yl)cyclohexane, 3,7,10-tricyclohexylpentadecane, decahydro-1-(pentadecan-6-yl)naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group can be optionally substituted with one or more, such as one to three, substituents. Representative examples include, but are not limited to, cyclopropyl, cyclobutyl, cyclohexyl, cyclopentyl, cycloheptyl, (pentadecan-6-yl)cyclohexane, and the like.

Molecules with multicycloparaffinic functionality mean any molecule that is a fused multicyclic saturated hydrocarbon ring group of two or more fused rings, any molecule that is substituted with one or more fused multicyclic saturated hydrocarbon ring groups of two or more fused rings, or any molecule that is substituted with more than one monocyclic saturated hydrocarbon group of three to seven ring carbons. The fused multicyclic saturated hydrocarbon ring group often is of two fused rings. The cycloparaffinic group can be optionally substituted with one or more, such as one to three, substituents. Representative examples include, but are not limited to, decahydronaphthalene, octahydropentalene, 3,7,10-tricyclohexylpentadecane, decahydro-1-(pentadecan-6-yl) naphthalene, and the like.

Brookfield Viscosity: ASTM D2983-04a is used to determine the low-shear-rate viscosity of automotive fluid lubricants at low temperatures. The low-temperature, low-shear-rate viscosity of automatic transmission fluids, gear oils, torque and tractor fluids, and industrial and automotive hydraulic oils are frequently specified by Brookfield viscosities.

Kinematic viscosity is a measurement of the resistance to flow of a fluid under gravity. Many base oils, lubricant compositions made from them, and the correct operation of equipment depends upon the appropriate viscosity of the fluid being used. Kinematic viscosity is determined by ASTM D445-06. The results are reported in $mm^2/s$.

Viscosity index (VI) is an empirical, unitless number indicating the effect of temperature change on the kinematic viscosity of the oil. Viscosity index is determined by ASTM D2270-04.

Pour point is a measurement of the temperature at which a sample of base oil will begin to flow under carefully controlled conditions. Pour point can be determined as described in ASTM D5950-02. The results are reported in degrees Celsius. Many commercial base oils have specifications for pour point. When base oils have low pour points, the base oils are also likely to have other good low temperature properties, such as low cloud point, low cold filter plugging point, and low temperature cranking viscosity.

Noack volatility is usually tested according to ASTM D5800-05 Procedure B. A more convenient method for calculating Noack volatility and one which correlates well with ASTM D5800-05 is by using a thermogravimetric analyzer (TGA) test by ASTM D6375-05. TGA Noack volatility is used throughout the present disclosure unless otherwise stated.

The base oils of the lubricant composition as disclosed herein also have excellent viscometric properties under low temperature and high shear, making them very useful in multigrade engine oils. The cold-cranking simulator apparent viscosity (CCS VIS) is a test used to measure the viscometric properties of base oils under low temperature and high shear. The test method to determine CCS VIS is ASTM D5293-02. Results are reported in mPa·s. CCS VIS has been found to correlate with low temperature engine cranking. Specifications for maximum CCS VIS are defined for automotive engine oils by SAE J300, revised in 2004. The maximum CCS VIS for a 0W SAE Viscosity Grade engine oil is 6200 mPa·s at −35° C.

The Mini-Rotary Viscometer (MRV) test, ASTM D4684-07, which is related to the mechanism of pumpability, is a low shear rate measurement. Slow sample cooling rate is the method's key feature. A sample is pretreated to have a specified thermal history which includes warming, slow cooling, and soaking cycles. The MRV measures an apparent yield stress, which, if greater than a threshold value, indicates a potential air-binding pumping failure problem. Above a certain viscosity (currently defined as 60,000 mPa·s by SAE J 300 2004), the oil may be subject to pumpability failure by a mechanism called "flow limited" behavior. An SAE 0W oil, for example, is required to have a maximum viscosity of 60,000 mPa·s at −40° C. with no yield stress. This method also measures an apparent viscosity under shear rates of 1 to 50 $s^{-1}$.

High temperature high shear rate viscosity (HTHS) is a measure of a fluid's resistance to flow under conditions resembling highly-loaded journal bearings in fired internal combustion engines, typically 1 million $s^{-1}$ at 150° C. HTHS is a better indication of how an engine operates at high temperature with a given lubricant than the kinematic low shear rate viscosities at 100° C. The HTHS value directly correlates to the oil film thickness in a bearing. SAE J300 2004 contains the current specifications for HTHS measured by either ASTM D4683, ASTM D4741, or ASTM D5481. An SAE 20 viscosity grade engine oil, for example, is required to have a minimum HTHS of 2.6 mPa·s.

Scanning Brookfield Viscosity: ASTM D5133-05 is used to measure the low temperature, low shear rate, viscosity/temperature dependence of engine oils. The low temperature, low shear viscometric behavior of an engine oil determines whether the oil will flow to the sump inlet screen, then to the oil pump, then to the sites in the engine requiring lubrication in sufficient quantity to prevent engine damage immediately or ultimately after cold temperature starting. ASTM D5133-05, the Scanning Brookfield Viscosity technique, measures the Brookfield viscosity of a sample as it is cooled at a constant rate of 1° C./hour. Like the MRV, ASTM D5133-05 is intended to relate to the pumpability of an oil at low temperatures. The test reports the gelation point, defined as the temperature at which the sample reaches 30,000 mPa·s. The gelation index is also reported, and is defined as the largest rate of change of viscosity increase from −5° C. to the lowest test temperature. The latest API SM/ILSAC GF-4 specifications for passenger car engine oils require a maximum gelation index of 12.

Highly Paraffinic Wax

The highly paraffinic wax used in making the base oil of the lubricant composition can be any wax having a high content of n-paraffins and having consecutive numbers of carbon atoms. In an embodiment, the highly paraffinic waxes also have very low levels of nitrogen and sulfur, generally less than 25 ppm total combined nitrogen and sulfur, for example, less than 20 ppm. In an embodiment, the pour points of the highly paraffinic waxes are greater than 50° C. or greater than 60° C.

It has been discovered that highly paraffinic waxes can be processed to provide base oil having low volatility, high viscosity index, and also having good additive solubility and elastomer compatibility. In an embodiment, the highly paraffinic wax is a Fischer-Tropsch derived wax and provides a Fischer-Tropsch derived base oil.

Fischer-Tropsch Synthesis

In Fischer-Tropsch chemistry, hydrogen and carbon monoxide is converted to liquid and gaseous hydrocarbons by contact with a Fischer-Tropsch catalyst under reactive conditions. Examples of conditions for performing Fischer-Tropsch type reactions are well known to those of skill in the art.

The Fischer-Tropsch synthesis products can be obtained by well-known processes such as, for example, the commercial SASOL® Slurry Phase Fischer-Tropsch technology, the commercial SHELL® Middle Distillate Synthesis (SMDS) Process, or by the non-commercial EXXON® Advanced Gas Conversion (AGC-21) process. Details of these processes and others are described in, for example, EP-A-776959, EP-A-668342, EP-B-450860; U.S. Pat. Nos. 4,943,672, 5,059,299, 5,348,982, 5,733,839 and RE39073; U.S. Patent Application Publication No. 2005/0227866, WO-A-9934917, WO-A-9920720 and WO-A-05107935. The Fischer-Tropsch synthesis product usually comprises hydrocarbons having 1 to 100, or even more than 100 carbon atoms, and typically includes paraffins, olefins and oxygenated products.

The slurry Fischer-Tropsch process utilizes superior heat (and mass) transfer characteristics for the strongly exothermic synthesis reaction and is able to produce relatively high molecular weight, paraffinic hydrocarbons when using a cobalt catalyst.

Certain Fischer-Tropsch catalysts are known to provide relatively high chain growth probabilities, and the reaction products include a relatively low proportion of low molecular ($C_{2-8}$) weight olefins and a relatively high proportion of high molecular weight ($C_{30+}$) waxes. Such catalysts are well known to those of skill in the art and can be readily obtained and/or prepared.

The product from a Fischer-Tropsch process contains predominantly paraffins. The products from Fischer-Tropsch reactions generally include a light reaction product and a waxy reaction product. The waxy reaction product (i.e., the waxy fraction) includes hydrocarbons boiling above about 600° F. (e.g., vacuum gas oil through heavy paraffins), largely in the $C_{20+}$ range, with decreasing amounts down to $C_{10}$.

The waxy reaction product generally comprises greater than 70 weight % normal paraffins, and often greater than 80 weight % normal paraffins. It is the waxy reaction product (i.e., the waxy fraction) that is used as a feedstock to the process for providing Fischer-Tropsch derived base oil in lubricant compositions.

The Fischer-Tropsch base oil of the lubricant composition can be prepared from the waxy fractions of the Fischer-Tropsch syncrude by a process including hydroisomerization. In an embodiment, the Fischer-Tropsch base oils are made by a process as described in U.S. Patent Application Publication Nos. 2005/0133409 A1 and 2006/0289337 A1. In an embodiment, the Fischer-Tropsch base oil of the lubricant composition is made by a process as described in U.S. Pat. No. 7,018,525. The Fischer-Tropsch base oil of the lubricant composition is often manufactured at a site different from the site at which the components of the lubricant compositions are received and blended.

Process for Providing Base Oil

In an embodiment, the base oil of the lubricant composition is made by a process comprising providing a highly paraffinic wax and then hydroisomerizing the highly paraffinic wax to provide the base oil. The highly paraffinic wax is hydroisomerized using a shape selective intermediate pore size molecular sieve comprising a noble metal hydrogenation component under conditions of about 600° F. to 750° F.

In an embodiment, the highly paraffinic wax is a Fischer-Tropsch derived wax and provides a Fischer-Tropsch derived base oil. Fischer-Tropsch derived base oil can be made by a Fischer-Tropsch synthesis process followed by hydroisomerization of the waxy fractions of the Fischer-Tropsch syncrude.

Hydroisomerization

The highly paraffinic waxes are subjected to a process comprising hydroisomerization to provide the base oil of the lubricant composition. Hydroisomerization is intended to improve the cold flow properties of the base oil by the selective addition of branching into the molecular structure. Hydroisomerization ideally will achieve high conversion levels of the highly paraffinic wax to non-waxy iso-paraffins while at the same time minimizing the conversion by cracking. In an embodiment, the conditions for hydroisomerization are controlled such that the conversion of the compounds boiling above about 700° F. in the waxy feed to compounds boiling below about 700° F. is maintained between about 10 and 50 weight %, for example between 15 and 45 weight %.

Hydroisomerization is conducted using a shape selective intermediate pore size molecular sieve. The hydroisomerization catalysts used comprise a shape selective intermediate pore size molecular sieve and optionally a catalytically active metal hydrogenation component on a refractory oxide support. The phrase "intermediate pore size", as used herein, means an effective pore aperture in the range of from about 3.9 to about 7.1 Å when the porous inorganic oxide is in the calcined form. The shape selective intermediate pore size molecular sieves used are generally 1-D 10-, 11- or 12-ring molecular sieves. In an embodiment, the molecular sieves are of the 1-D 10-ring variety, where 10- (or 11- or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings can also be encompassed within the definition of molecular sieve. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Other shape selective intermediate pore size molecular sieves used for hydroisomerization are based upon aluminum phosphates, such as SAPO-11, SAPO-31, and SAPO-41. SM-3 is an example of a good shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Metal loaded small crystallite MTT molecular sieves are also good shape selective intermediate pore size molecular sieves. The preparation of metal loaded small crystallite MTT molecular sieve catalysts are described in U.S. patent application Ser. No. 11/866,281, filed Oct. 2, 2007. Other shape selective intermediate pore size molecular sieves used for hydroisomerization are zeolites, such as ZSM-22, ZSM-23, ZSM-35, ZSM-48, ZSM-57, SSZ-32, offretite, and ferrierite.

In an embodiment, an intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Å, having a maximum crystallographic free diameter of not more than 7.1 and a minimum crystallographic free diameter of not less than 3.9 Å. In this embodiment, the maximum crystallographic free diameter is not more than 7.1 and the minimum crystallographic free diameter is not less than 4.0 Å. In an embodiment, the maximum crystallographic free diameter is not more than 6.5 and the minimum crystallographic free diameter is not less than 4.0 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15.

An example of an intermediate pore size molecular sieve is described, for example, in U.S. Pat. Nos. 5,135,638 and 5,282,958. In U.S. Pat. No. 5,282,958, such an intermediate pore size molecular sieve has a crystallite size of no more than about 0.5 microns and pores with a minimum diameter of at least about 4.8 Å and with a maximum diameter of about 7.1 Å. The catalyst has sufficient acidity so that 0.5 grams thereof when positioned in a tube reactor converts at least 50% of hexadecane at 370° C., a pressure of 1200 psig, a hydrogen flow of 160 ml/min, and a feed rate of 1 ml/hr. The catalyst also exhibits isomerization selectivity of 40 percent or greater (isomerization selectivity is determined as follows: 100×(weight % branched $C_{16}$ in product)/(weight % branched $C_{16}$ in product+weight % $C_{13-}$ in product) when used under conditions leading to 96% conversion of normal hexadecane (n-$C_{16}$) to other species.

In an embodiment, the molecular sieve can further be characterized by pores or channels having a crystallographic free diameter in the range of from about 4.0 to about 7.1 Å, for example, in the range of 4.0 to 6.5 Å. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871. In performing adsorption measurements to determine pore size, standard techniques are used. It is convenient to consider a particular molecule as excluded if does not reach at least 95% of its equilibrium adsorption value on the molecular sieve in less than about 10 minutes ($p/p_o$=0.5 at 25° C.). Intermediate pore size molecular sieves will typically admit molecules having kinetic diameters of 5.3 to 6.5 Å with little hindrance.

Hydroisomerization catalysts often comprise a catalytically active hydrogenation metal. The presence of a catalytically active hydrogenation metal leads to product improvement, especially viscosity index and stability. Typical catalytically active hydrogenation metals include chromium, molybdenum, nickel, vanadium, cobalt, tungsten, zinc, platinum, and palladium. In an embodiment the catalytically active hydrogen metals are selected from platinum, palladium, and mixtures thereof. If platinum and/or palladium is used, the total amount of active hydrogenation metal is typically in the range of 0.1 to 5 weight percent of the total catalyst, usually from 0.1 to 2 weight percent, and not to exceed 10 weight percent.

The refractory oxide support can be selected from those oxide supports, which are conventionally used for catalysts, including silica, alumina, silica-alumina, magnesia, titania and combinations thereof.

The conditions for hydroisomerization will be tailored to achieve a base oil comprising greater than 5 weight % molecules with cycloparaffinic functionality. In an embodiment, the conditions provide a base oil comprising a ratio of weight percent of molecules with monocycloparaffinic functionality of weight percent of molecules with multicycloparaffinic functionality of greater than 5, such as greater than 10, greater than 15, or greater than 20. The conditions for hydroisomerization will depend on the properties of feed used, the catalyst used, whether or not the catalyst is sulfided, the desired yield, and the desired properties of the base oil. Conditions under which the hydroisomerization process can be carried out include temperatures from about 500° F. to about 775° F. (260° C. to about 413° C.), such as 600° F. to about 750° F. (315° C. to about 399° C.), or 600° F. to about 700° F.(315° C. to about 371° C.); and pressures from about 15 to 3000 psig, such as 100 to 2500 psig. The hydroisomerization pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 to 20 $hr^{-1}$, for example, from about 0.1 to about 5 $hr^{-1}$. The hydrogen to hydrocarbon ratio falls within a range from about 1.0 to about 50 moles $H_2$ per mole hydrocarbon, for example, from about 10 to about 20 moles $H_2$ per mole hydrocarbon. Suitable conditions for performing hydroisomerization are described in U.S. Pat. Nos. 5,282,958 and 5,135,638.

In an embodiment, the hydroisomerization conditions are selected to produce a base oil having between 2 and 10 weight % naphthenic carbon, between 90 and 98 weight % paraffinic carbon, and less than 1 weight % aromatic carbon by n-d-M with normalization. N-d-M analysis is done by ASTM D 3238-95 (Reapproved 2005) with normalization. Weight percent aromatic carbon ("Ca", weight percent napthenic carbon ("Cn") and weight percent paraffinic carbon ("Cp") in an embodiment can be measured by ASTM D3238-95 (Reapproved 2005) with normalization. ASTM D3238-95 (Reapproved 2005) is the Standard Test Method for Calculation of Carbon Distribution and Structural Group Analysis of Petroleum Oils by the n-d-M Method. This method is for "olefin free" feedstocks which are assumed in this application to mean that that olefin content is 2 weight % or less. The normalization process consists of the following: A) If the Ca value is less than zero, Ca is set to zero, and Cn and Cp are increased proportionally so that the sum is 100%; B) If the Cn value is less than zero, Cn is set to zero, and Ca and Cp are increased proportionally so that the sum is 100%; and C) If both Cn and Ca are less than zero, Cn and Ca are set to zero, and Cp is set to 100%.

Hydrogen is present in the reaction zone during the hydroisomerization process, typically in a hydrogen to feed ratio from about 0.5 to 30 MSCF/bbl (thousand standard cubic feet per barrel), such as from about 1 to about 10 MSCF/bbl. In an embodiment, the hydrogen to feed ratio is from about 712.4 to about 3562 liter $H_2$/liter oil (about 4 to about 20 MSCF/bbl). Hydrogen will sometimes be separated from the product and recycled to the reaction zone.

Hydrotreating

The highly paraffinic waxy feed to the hydroisomerization process will sometimes be hydrotreated prior to hydroisomerization. Hydrotreating refers to a catalytic process, usually carried out in the presence of free hydrogen, in which the primary purpose is the removal of various metal contaminants, such as arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated.

Hydrofinishing

Hydrofinishing is a hydrotreating process that will often be used as a step following hydroisomerization to provide base oil derived from highly paraffinic wax. Hydrofinishing can be employed to improve oxidation stability, UV stability, and appearance of base oil by removing traces of aromatics, olefins, color bodies, and solvents. As used herein, the term UV stability refers to the stability of base oil or lubricant compositions when exposed to UV light and oxygen. Instability is indicated when a visible precipitate forms, usually seen as floc or cloudiness, or a darker color develops upon exposure to ultraviolet light and air. A general description of hydrofinishing can be found in U.S. Pat. Nos. 3,852,207 and 4,673,487. Clay treating to remove impurities is an alternative final process step to provide base oil derived from highly paraffinic wax.

Fractionation

Optionally, the process to provide the light base oil derived from highly paraffinic wax can include fractionating the highly paraffinic waxy feed prior to hydroisomerization, or fractionating of base oil obtained from the hydroisomerization process. The fractionation of the highly paraffinic waxy feed or the isomerized base oil into fractions is generally accomplished by either atmospheric or vacuum distillation, or by a combination of atmospheric and vacuum distillation.

Atmospheric distillation is typically used to separate the lighter distillate fractions, such as naphtha and middle distillates, from a bottoms fraction having an initial boiling point above about 600° F. to about 750° F. (about 315° C. to about 399° C.). At higher temperatures thermal cracking of the hydrocarbons can take place leading to fouling of the equipment and to lower yields of the heavier cuts. Vacuum distillation is typically used to separate the higher boiling material, such as base oil, into different boiling range cuts. Fractionating base oil into different boiling range cuts enables base oil manufacturing plant to produce more than one grade, or viscosity, of base oil.

Solvent Dewaxing

The process to make base oil derived from highly paraffinic wax will sometimes also includes a solvent dewaxing step either before or following the hydroisomerization process. Solvent dewaxing optionally can be used to remove small amounts of remaining waxy molecules from base oil after hydroisomerization. Solvent dewaxing is done by dissolving base oil in a solvent, such as methyl ethyl ketone, methyl iso-butyl ketone, or toluene, or precipitating the wax molecules as discussed in Chemical Technology of Petroleum, 3rd Edition, William Gruse and Donald Stevens, McGraw-Hill Book Company, Inc., New York, 1960, pages 566 to 570. Solvent dewaxing is also described in U.S. Pat. Nos. 4,477,333, 3,773,650 and 3,775,288.

In an embodiment, the base oil is made by the process steps of: a) hydroisomerization dewaxing a waxy feed using a shape selective intermediate pore size molecular sieve to produce an intermediate oil isomerate, wherein the intermediate oil isomerate comprises paraffinic hydrocarbon components in which the extent of branching is less than 7 alkyl branches per 100 carbons; b) analyzing the intermediate oil isomerate to determine that the intermediate oil isomerate comprises paraffinic hydrocarbon components in which the extent of branching is less than 7 alkyl branches per 100 carbons; and c) solvent dewaxing the intermediate oil isomerate to produce a lubricant base oil wherein the lubricant base oil comprises paraffinic hydrocarbon components in which the extent of branching is less than 8 alkyl branches per 100 carbons and less than 20 weight % of the alkyl branches are at the 2 position; the lubricant base oil having a pour point of less than −8° C.; a kinematic viscosity at 100° C. of about 3.2 cSt or greater; and a Viscosity Index greater than a Target Viscosity Index as calculated by the following equation:

$$\text{Target Viscosity Index}=22\times Ln(\text{Kinematic Viscosity at } 100^\circ\text{ C.})+132.$$

Base Oil Derived from Highly Paraffinic Wax

Base oil derived from highly paraffinic wax is suitable for use in lubricant compositions. In an embodiment, the base oil of the lubricant composition comprises less than 5 weight %, such as less than 1 weight % or less than 0.5 weight %, of unsaturates. The base oil of the lubricant composition generally comprises less than 0.30 weight percent molecules with aromatic functionality, such as less than 0.1 or less than 0.05 weight percent, In an embodiment, the base oil of the lubricant composition comprises greater than 5 weight percent molecules with cycloparaffinic functionality. In an embodiment, the base oil of the lubricant composition comprises a ratio of weight % of molecules with monocycloparaffinic functionality to weight % of molecules with multicycloparaffinic functionality of greater than 5, such as greater than 10, greater than 15, or greater than 20.

In an embodiment, the base oil of the lubricant composition comprises less than 19 alkyl branches/100 carbons, for example, greater than 9 alkyl branches/100 carbons and less than 19 alkyl branches/100 carbons. The base oil of the lubricant composition can also have specific alkyl branching placements. In an embodiment, the base oil of the lubricant composition comprises predominantly methyl branching, and the branching is such that there are 6 to 18 alkyl branches per 100 carbons; greater than 25% of the branches are 5 or more carbon atoms apart from each other; and less than 40% of the branches are within 2 to 3 carbon atoms apart from each other. Examples of these types of base oils are taught in U.S. Patent Application Publication No. 2005/0077208 A1.

Base oil containing desired levels of molecules with cycloparaffinic functionality exhibits good solubility for additives, including viscosity index improvers and lubricant additive packages, because molecules with cycloparaffinic functionality impart additive solubility. Base oil containing a high ratio of weight percent of molecules with monocycloparaffinic functionality to weight percent of molecules with multicycloparaffinic functionality (or high weight percent of molecules with monocycloparaffinic functionality and low weight percent of molecules with multicycloparaffinic functionality) are also desirable because molecules with multicycloparaffinic functionality reduce oxidation stability, lower viscosity index, and increase Noack volatility. Accordingly, the base oil exhibits good oxidation stability and low Noack volatility.

In an embodiment, the base oil of the lubricant composition contains greater than 95 weight % saturates, such as greater than 99 weight % or greater than 99.5 weight %, as determined by elution column chromatography, ASTM D2549-02. Olefins are present in an amount less than detectable by long duration $C^{13}$ Nuclear Magnetic Resonance Spectroscopy (NMR). In an embodiment, molecules with aromatic functionality are present in amounts less than 0.3 weight percent by HPLC-UV, and confirmed by ASTM D5292-99 modified to measure low level aromatics. In an embodiment, molecules with aromatic functionality are present in amounts less than 0.10 weight percent, such as less than 0.05 weight percent, or less than 0.01 weight percent. Sulfur is present in amounts less than 25 ppm, such as 5 ppm, or less than 1 ppm as determined by ultraviolet fluorescence by ASTM D5453-06.

Base oil derived from highly paraffinic wax does not introduce any undesirable characteristics, including, for example, high volatility, high viscosity, and impurities such as heteroatoms, to the lubricant composition. In an embodiment, the base oil is a Fischer-Tropsch derived base oil. Fischer-Tropsch derived waxes are particularly well suited for providing Fischer-Tropsch derived base oil with the above-described properties.

In an embodiment, the isomerized base oil has a relatively low traction coefficient, specifically, its traction coefficient is less than an amount calculated by the equation:

$$\text{traction coefficient}=0.009\times Ln(\text{kinematic viscosity in } mm^2/s)-0.001,$$

wherein the kinematic viscosity in the equation is the kinematic viscosity during the traction coefficient measurement and is between 2 and 50 $mm^2/s$. In an embodiment, the isomerized base oil has a traction coefficient of less than 0.023 (or less than 0.021) when measured at a kinematic viscosity of 15 $mm^2/s$ and at a slide to roll ratio of 40%. In an embodiment, the isomerized base oil has a traction coefficient of less than 0.017 when measured at a kinematic viscosity of 15 $mm^2/s$ and at a slide to roll ratio of 40%. In an embodiment, the isomerized base oil has a viscosity index greater than 150 and a traction coefficient less than 0.015 when measured at a kinematic viscosity of 15 $mm^2/s$ and at a slide to roll ratio of 40 percent.

In embodiments, the isomerized base oil having low traction coefficients also displays a higher kinematic viscosity and higher boiling points. In an embodiment, the base oil has a traction coefficient less than 0.015, and a 50 weight % boiling point greater than 565° C. (1050° F.). In an embodiment, the base oil has a traction coefficient less than 0.011 and a 50 weight % boiling point by ASTM D6352-04 greater than 582° C. (1080° F.).

In embodiments, the isomerized base oil having low traction coefficients also displays unique branching properties by NMR, including a branching index less than or equal to 23.4, a branching proximity greater than or equal to 22.0, and a Free Carbon Index between 9 and 30. In an embodiment, the base oil has at least 4 weight % naphthenic carbon, in another embodiment, at least 5 weight % naphthenic carbon by n-d-M analysis by ASTM D 3238-95 (Reapproved 2005) with normalization.

Base Oil Traction Coefficients:

Traction data were obtained with an MTM Traction Measurement System from PCS Instruments, Ltd. The unit was configured with a polished 19 mm diameter ball (SAE AISI 52100 steel) angled at 24° to a flat 46 mm diameter polished disk (SAE AISI 52100 steel). Measurements were made at 40° C., 70° C., 100° C., and 120° C. The steel ball and disk were driven independently by two motors at an average rolling speed of 3 Meters/sec and a slide to roll ratio of 40% [defined as the difference in sliding speed between the ball and disk divided by the mean speed of the ball and disk. SRR=(Speed1-Speed2)/((Speed1+Speed2)/2)]. The load on the ball/disk was 20 Newton resulting in a maximum contact stress of 0.819 GPa.

The traction coefficient data of each oil was plotted against its respective kinematic viscosity data at each test temperature (40° C., 70° C., 100° C., and 120° C.). That is, the kinematic viscosity of an oil at 40° C. [x coordinate] was paired with its corresponding traction data at 40° C. [y coordinate], etc. Since kinematic viscosity information was generally only available at 40° C. and 100° C., the 70° C. and 120° C. kinematic viscosities were estimated from the 40° C. and 100° C. data using the well known Walther Equation:

$$[\mathrm{Log}_{10}(\mathrm{Log}_{10}(\mathrm{vis}+0.6))=a-c*\mathrm{Log}_{10}(\mathrm{Temp},\ ^\circ\ \mathrm{K})].$$

The Walther Equation is the most widely used equation for estimating viscosities at odd temperatures and forms the basis for the ASTM D341 viscosity-temperature charts. Results for each oil were reported on a linear fit of the log traction coefficient data versus kinematic viscosity in $mm^2/s$. The traction coefficient result for each oil at 15 $mm^2/s$ kinematic viscosity was read off of the plots and tabulated.

Aromatics Measurement by HPLC-UV.

The method used to measure low levels of molecules with aromatic functionality in the base oils uses a Hewlett Packard 1050 Series Quaternary Gradient High Performance Liquid Chromatography (HPLC) system coupled with a HP 1050 Diode-Array UV-Vis detector interfaced to an HP Chemstation. Identification of the individual aromatic classes in the highly saturated base oils was made on the basis of their UV spectral pattern and their elution time. The amino column used for this analysis differentiates aromatic molecules largely on the basis of their ring-number (or more correctly, double-bond number). Thus, the single ring aromatic containing molecules would elute first, followed by the polycyclic aromatics in order of increasing double bond number per molecule. For aromatics with similar double bond character, those with only alkyl substitution on the ring would elute sooner than those with cycloparaffinic substitution.

Unequivocal identification of the various base oil aromatic hydrocarbons from their UV absorbance spectra was somewhat complicated by the fact their peak electronic transitions were all red-shifted relative to the pure model compound analogs to a degree dependent on the amount of alkyl and cycloparaffinic substitution on the ring system. These bathochromic shifts are well known to be caused by alkyl-group delocalization of the π-electrons in the aromatic ring. Since few unsubstituted aromatic compounds boil in the lubricant range, some degree of red-shift was expected and observed for all of the principle aromatic groups identified.

Quantification of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-cycloalkyl-1-ring aromatics and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-cycloalkyl-1-ring aromatics in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the base oil using a Waters semi-preparative HPLC unit. Ten grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of molecules with aromatic functionality in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D5292-99 method was modified to give a minimum carbon sensitivity of 500:1 (by ASTM standard practice E 386). A 15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Cycloparaffin Distribution by FIMS:

Paraffins are considered more stable than cycloparaffins towards oxidation, and therefore, more desirable. Monocycloparaffins are considered more stable than multicycloparaffins towards oxidation. However, when the weight percent of all molecules with at least one cycloparaffinic function is very low in an oil, the additive solubility is low and the elastomer compatibility is poor. Examples of oils with these properties are Fischer-Tropsch oils with less than about 5% cycloparaffins. To improve these properties in lubricant compositions, expensive co-solvents such as esters must often be added. In an embodiment, base oil derived from highly paraffinic wax comprises a high weight percent of molecules with monocycloparaffinic functionality and a low weight percent of molecules with multicycloparaffinic functionality, such that the base oil has high oxidation stability, low volatility, good miscibility with other oils, good additive solubility, and good elastomer compatibility.

The base oils of the lubricant composition were characterized by field ionization mass spectroscopy (FIMS) into alkanes and molecules with different numbers of unsaturations. The distribution of molecules in the base oil was determined by FIMS. FIMS spectra were obtained on a Micromass VG 70VSE mass spectrometer. The samples were introduced via a solid probe into the spectrophotometer, for example, by placing a small amount (about 0.1 mg) of the base oil to be tested in a glass capillary tube. The capillary tube was placed at the tip of a solids probe for a mass spectrometer, and the probe was heated from about 40° C. up to 500° C. at a rate of 50° C. per minute, operating under vacuum at approximately $10^{-6}$ Torr. The mass spectrometer was scanned from m/z 40 to m/z 1000 at a rate of 5 seconds per decade. The acquired mass spectra were summed to generate one "averaged" spectrum. Each spectrum was $^{13}C$ corrected using a software package from PC-MassSpec.

Response factors for all compound types were assumed to be 1.0, such that weight percent was determined from area percent. The acquired mass spectra were summed to generate one "averaged" spectrum. The output from the FIMS analysis is the average weight percents of alkanes, 1-unsaturations, 2-unsaturations, 3-unsaturations, 4-unsaturations, 5-unsaturations, and 6-unsaturations in the test sample.

The molecules with different numbers of unsaturations can be comprised of cycloparaffins, olefins, and aromatics. If aromatics were present in significant amounts in the base oil they would most likely be identified in the FIMS analysis as 4-unsaturations. When olefins were present in significant amounts in the base oil they would most likely be identified in the FIMS analysis as 1-unsaturations. The total of the 1-unsaturations, 2-unsaturations, 3-unsaturations, 4-unsaturations, 5-unsaturations, and 6-unsaturations from the FIMS analysis, minus the weight percent of olefins by proton NMR, and minus the weight percent of aromatics by HPLC-UV is the total weight percent of molecules with cycloparaffinic functionality in the base oils of the lubricant composition. The total of the 2-unsaturations, 3-unsaturations, 4-unsaturations, 5-unsaturations, and 6-unsaturations from the FIMS analysis, minus the weight percent of aromatics by HPLC-UV is the weight percent of molecules with multicycloparaffinic functionality in the base oils of the lubricant composition. Note that if the aromatics content was not measured, it was assumed to be less than 0.1 weight % and not included in the calculation for total weight percent of molecules with cycloparaffinic functionality.

In an embodiment, base oil derived from highly paraffinic wax has a weight percent of molecules with cycloparaffinic functionality greater than 5. In an embodiment, base oil derived from highly paraffinic wax also has a high ratio of weight percent of molecules with monocycloparaffinic functionality to weight percent of molecules with multicycloparaffinic functionality, generally greater than 5, greater than 10, greater than 15, or greater than 20.

In an embodiment, there is a relationship between the weight percent of all molecules with at least one cycloparaffinic functionality and the kinematic viscosity of the base oils of the lubricant composition, derived from highly paraffinic wax. That is, the higher the kinematic viscosity at 100° C. in $mm^2/s$, the higher the amount of molecules with cycloparaffinic functionality that are obtained.

The modified ASTM D5292-99 and HPLC-UV test methods used to measure low level aromatics, and the FIMS test method used to characterize saturates are described in D. C. Kramer, et al., "Influence of Group II & III Base Oil Composition on viscosity index and Oxidation Stability", presented at the 1999 AIChE Spring National Meeting in Houston, Mar. 16, 1999, the contents of which is incorporated herein in its entirety.

Although the highly paraffinic waxy feeds are essentially free of olefins, base oil processing techniques can introduce olefins, especially at high temperatures, due to "cracking" reactions. In the presence of heat or UV light, olefins can polymerize to form higher molecular weight products that can color the base oil or cause sediment. In general, olefins can be removed by hydrofinishing or by clay treatment.

Lubricant Composition

Base oils are the most important component of lubricant compositions, generally comprising greater than 70% of the lubricant compositions. Lubricant compositions comprise a base oil and at least one additive. Lubricant compositions can be used in automobiles, diesel engines, axles, transmissions, and industrial applications. Lubricant compositions must meet the specifications for their intended application as defined by the concerned governing organization.

Additives, which can be blended with the base oil, to provide a lubricant composition include those which are intended to improve select properties of the lubricant composition. Typical additives include, for example, anti-wear additives, extreme pressure agents, detergents (e.g., metal-containing detergents), dispersants (e.g., ashless dispersants), antioxidants, pour point depressants, VI Improvers (VII), viscosity modifiers, friction modifiers, demulsifiers, antifoaming agents, inhibitors (e.g., corrosion inhibitors, rust inhibitors, etc.), seal swell agents, emulsifiers, wetting agents, lubricity improvers, metal deactivators, gelling agents, tackiness agents, bactericides, fluid-loss additives, colorants, and the like. Additives can be added in the form of an additive package, containing various additives.

The present lubricant composition comprises a detergent inhibitor additive package. Typically, the total amount of additives in the lubricant composition will be approximately 1 to about 30 weight percent of the lubricant composition. The use of additives in formulating lubricant compositions is well documented in the literature and well known to those of skill in the art.

EXAMPLES

The following illustrative examples are intended to be non-limiting. Table 2 provides characteristics of the Fisher-Tropsch derived lubricant base oil composition used in the lubricant composition of the example.

TABLE 2

| | Fisher-Tropsch Derived Lubricant Base Oil |
|---|---|
| Kinematic Viscosity @ 40° C., $mm^2/s$ | 17.69 |
| Kinematic Viscosity @ 100° C., $mm^2/s$ | 4.213 |
| Viscosity Index | 149 |
| X in the equation: VI = 28 × Ln(KV@100) + X | 108.7 |
| CCS Viscosity @ −40° C., mPa · s | 2,979 |
| CCS Viscosity @ −35° C., mPa · s | 1,699 |
| CCS Viscosity @ −30° C., mPa · s | 944 |
| Pour Point, ° C. | −14 |
| Oxidator BN, hrs | 41.03 |
| TGA Noack, wt % | 12.12 |
| HPLC-UV | |
| Aromatics Total | 0.01166 |
| SIMDIST TBP (wt %), ° F. | |
| 0.5 | 616 |
| 5 | 743 |
| 10 | 760 |
| 20 | 781 |
| 30 | 796 |
| 40 | 811 |
| 50 | 823 |
| 60 | 835 |
| 70 | 847 |
| 80 | 859 |
| 90 | 874 |
| 95 | 884 |
| 99.5 | 905 |
| $T_{95}$-$T_5$ Boiling Range Distribution, ° F. (° C.) | 141 (78) |
| FIMS | |
| Alkanes | 75.5 |
| 1-Unsaturation | 21.5 |
| 2-Unsaturation | 2.3 |
| 3-Unsaturation | 0.2 |
| 4-Unsaturation | 0.2 |
| 5-Unsaturation | 0.1 |
| 6-Unsaturation | 0.2 |
| % Olefins by Proton NMR | 0.00 |
| n-d-M, (normalized) | |
| Wt % Paraffinic Carbon | 94.98 |
| Wt % Naphthenic Carbon | 5.02 |
| Wt % Aromatic Carbon | 0.00 |
| Molecules with Monocycloparaffinic Functionality | 21.5 |
| Molecules with Multicycloparaffinic Functionality | 3.0 |
| Monocycloparaffins/Multicycloparaffins | 7.2 |
| Traction Coefficient at 15 $mm^2/s$ and 40% SRR | 0.021 |

In an embodiment, a base oil with a high viscosity index is used, such that it provides better lubricant performance over a broad range of operating temperatures. In an embodiment, the base oil is manufactured by a process such that the base oil has a Viscosity index greater than a Viscosity Index Factor equal to $$28 \times \mathrm{Ln}(\text{Kinematic Viscosity at } 100^\circ \text{ C.}) + 95$$

or $$28 \times \mathrm{Ln}(\text{Kinematic Viscosity at } 100^\circ \text{ C.}) + 105.$$

Processes to produce these types of oils are described in U.S. Pat. No. 7,282,134 and U.S. Patent Application Publication No. 2006/0289337. In other embodiment, the viscosity index of the base oil may be even higher, such as greater than an amount defined by the equation:

$$22 \times \mathrm{Ln}(\text{Kinematic Viscosity at } 100^\circ \text{ C.}) + 132.$$

These base oils are described in U.S. Patent Application Publication No. 2005/0077209.

Using the same DI additive package and VII, five (5) lubricant compositions were formulated and tested, the results of which can be found in Table 3. In Table 3, the PAO was Chevron Synfluid® PAO 4 cSt, the Group III Base Oil was Chevron UCBO 4R, the Group II Base Oil was Chevron Neutral Oil 100R, the ester was Synative ES 2960, the DI was OLOA 6194E, and the VII was Viscoplex 6-985, a polymethacrylate dispersant VII with pour point depressant functionality.

TABLE 3

| | Commercial Synthetic 0W-30 | PAO Variant | Fisher-Tropsch Derived Lubricant Base Oil Variant | Group III Variant | Group II Variant |
|---|---|---|---|---|---|
| PAO (wt %) | 61.7 | 76.89 | — | — | — |
| Fisher-Tropsch Derived Lubricant Base Oil (wt %) | — | — | 76.89 | — | — |
| Group III Base Oil (wt %) | — | — | — | 76.89 | — |
| Group II Base Oil (wt %) | — | — | — | — | 76.89 |
| Ester (wt %) | 15 | — | — | — | — |
| DI (wt %) | 17.59 | 17.52 | 17.52 | 17.52 | 17.52 |
| VII (wt %) | 5.71 | 5.59 | 5.59 | 5.59 | 5.59 |
| Kinematic Viscosity @ 40° C. ($mm^2/s$) | 49.92 | 54.94 | 43.32 | 52.37 | 63.59 |
| Kinematic Viscosity @ 100° C. ($mm^2/s$) | 10.15 | 9.562 | 9.678 | 10.41 | 11.33 |
| VI | 197 | 199 | 218 | 193 | 174 |
| CCS Viscosity @ −35° C. (mPa · s) | 4230 | 3986 | 4560 | 6909 | 20595 |
| Pour Point (° C.) | −53 | −61 | −40 | −44 | −42 |
| MRV @ −40° C. (ASTM D4684) (mPa · s) | 10585 | 9209 | 16048 | 19358 | 63422 |
| MRV @ −40° C. Yield Stress | No Yield Stress | No Yield Stress | No Yield Stress | No Yield Stress | No Yield Stress |
| Scanning Brookfield | | | | | |
| Viscosity @ −40° C. (mPa · s) | 10400 | 9600 | 41500 | 30000 | >40000 |
| Gelation Index | 5 | 4.2 | 7.3 | 5.2 | 5.2 |
| Base Oil Blend Viscosity at 100° C. (ASTM D445) ($mm^2/s$) | 3.976 | 3.823 | 4.213 | 4.135 | 4.137 |
| NOACK Volatility (ASTM D5800) (%) | 12.4 | 12.5 | 15.17 | 15.04 | 20.67 |
| HTHS @ 150° C. (ASTM 4683) (mPa · s) | 3.04 | 2.88 | 3.01 | 3.12 | 3.29 |

One way to predict engine oil fuel economy performance is by measuring the traction coefficient of an oil. Engine lubricants with lower traction coefficients can be more fuel-efficient. Accordingly, fuel economy performance was compared using the Traction Coefficient Test Method. Traction data was obtained with an MTM Traction Measurement System from PCS Instruments, Ltd. The unit was configured with a polished 19 mm diameter ball (SAE AISI 52100 steel) angled at 24° to a flat 46 mm diameter polished disk (SAE AISI 52100 steel). Measurements were made over a range of temperatures from room temperature to 150° C. The steel ball and disk were driven independently by two motors at an average rolling speed (mean entrainment speed) of 3.0 meters/sec and a slide to roll ratio of 40% [defined as the difference in sliding speed between the ball and disk divided by the mean speed of the ball and disk. SRR=(Speed1−Speed2)/((Speed1+Speed2)/2)]. The load on the ball/disk was 20 or 75 Newton, resulting in a maximum contact stress of 0.81 or 1.27 GPa, respectively.

Figure 2:
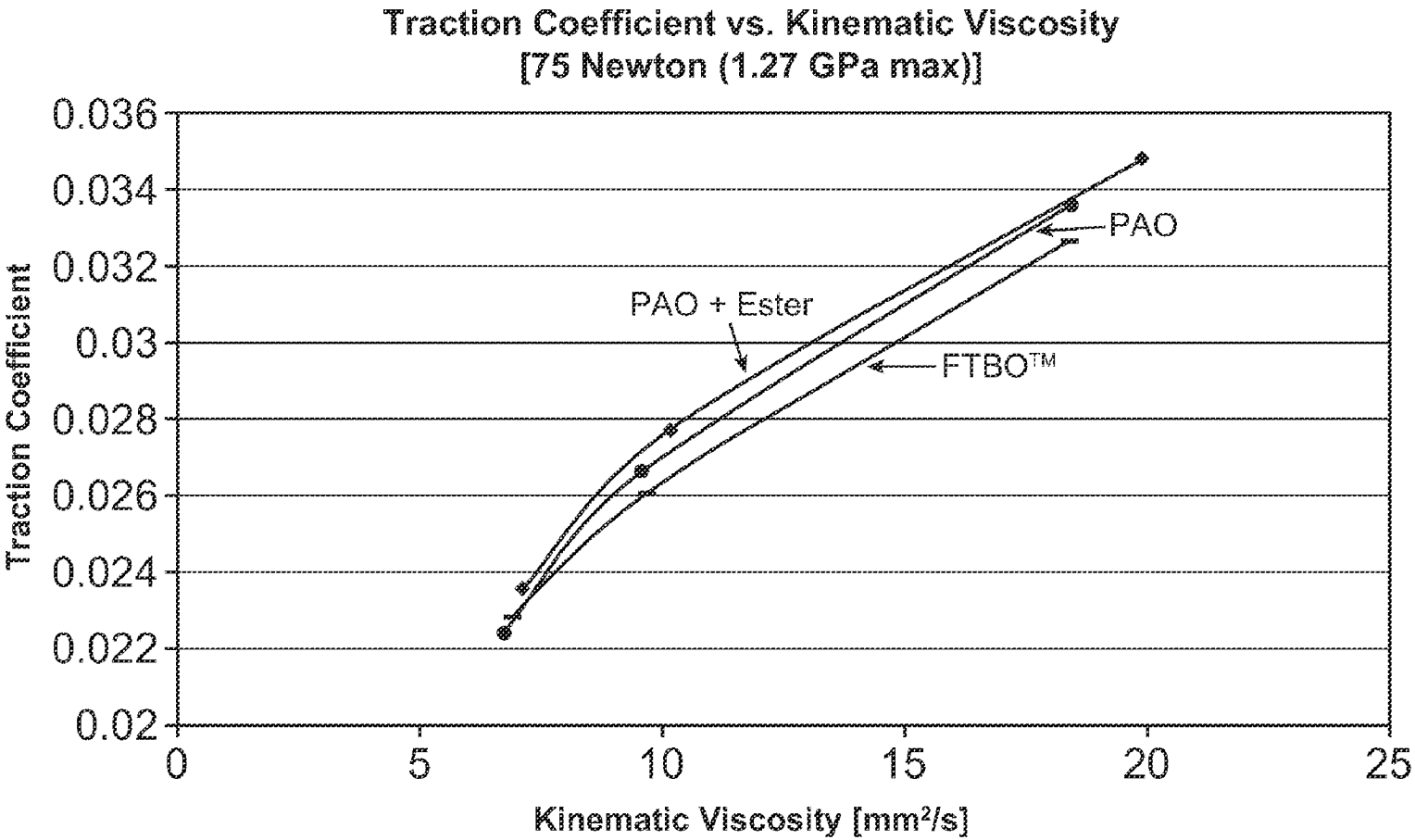

Results of tests according to the Traction Coefficient Test Method are presented in FIGS. 1 and 2. FIG. 1 is a graph of Traction Coefficient versus Kinematic Viscosity for testing with a load on the ball/disk of 20 Newton. Results are presented for the five lubricant compositions of Table 3—Commercial Synthetic 0W-30 or PAO+Ester, PAO, Fisher-Tropsch derived lubricant base oil, Group III, and Group II. According to FIG. 1, the Fisher-Tropsch derived lubricant base oil variant exhibited a comparative trend of lower Traction Coefficient than any of the other lubricant composition variants. FIG. 2 is a graph of Traction Coefficient versus Kinematic Viscosity for testing with a load on the ball/disk of 75 Newton. Results are presented for three of the five lubricant compositions of Table 3—PAO+Ester, PAO, and Fisher-Tropsch derived lubricant base oil. According to FIG. 2, the Fisher-Tropsch derived lubricant base oil variant exhibited a comparative trend of lower Traction Coefficient than any of the other tested lubricant composition variants.

All of the publications, patents and patent applications cited herein are herein incorporated by reference in their entirety to the same extent as if the disclosure of each individual publication, patent application or patent was specifically and individually indicated to be incorporated by reference in its entirety.

Many modifications of the exemplary embodiments disclosed herein will readily occur to those of skill in the art. Accordingly, the present disclosure is to be construed as including all structure and methods that fall within the scope of the appended claims.

What is claimed is:

1. A lubricant composition comprising:

a) a base oil comprising a consecutive number of carbon atoms and greater than 10 weight % and less than 70 weight % cycloparaffins, wherein the cycloparaffins have a ratio of monocycloparaffins to multiocycloparaffins of greater than 15, and having a viscosity index greater than a Viscosity Index Factor calculated by the following equation:

$$28 \times Ln(\text{Kinematic Viscosity at } 100^\circ \text{ C.}) + 95;$$

b) greater than 15 weight % DI additive package; and c) less than 7 weight % VI improver;

wherein the lubricant composition has:

a traction coefficient less than 0.023 when measured at a kinematic viscosity of 1 $mm^2/s$ and a slide to roll ratio of 40%;

a dynamic viscosity at −35° C. of less than 6200 mPa·s;

an MRV at −40° C. of less than 60,000 mPa·s; and a CCS Viscosity at −35° C. of less than 6200 mPa·s.

2. The lubricant composition of claim 1, wherein the lubricant composition comprises less than 0.1 weight % pour point depressant.

3. The lubricant composition of claim 1, wherein the base oil comprises less than 10 weight % esters.

4. The lubricant composition of claim 1, wherein the base oil comprises greater than 15 weight % and less than 70 weight % cycloparaffins.

5. The lubricant composition of claim 1, wherein the base oil has a ratio of monocycloparaffins to multicycloparaffins of greater than 20.

6. The lubricant composition of claim 1, wherein the base oil has a viscosity index greater than a Viscosity Index Factor calculated by the following equation:

$$28 \times Ln(\text{Kinematic Viscosity at } 100^\circ \text{ C.}) + 105.$$

7. The lubricant composition of claim 1, wherein the base oil is made from a Fischer-Tropsch wax.

8. The lubricant composition of claim 1, wherein the base oil has a viscosity at 100° C. between 3.5 and 4.5 $mm^2/s$.

9. The lubricant composition of claim 1, wherein the lubricant composition comprises less than 5.6 weight % VI improver.

10. The lubricant composition of claim 1, wherein the lubricant composition has an MRV at −40° C. of less than 25,000 mPa·s.

11. The lubricant composition of claim 1, wherein the lubricant composition has a CCS Viscosity at −35° C. of less than 5200 mPa·s.

12. The lubricant composition of claim 1, wherein the base oil is derived from a highly paraffinic feed that was dewaxed by hydroisomerization dewaxing.

13. The lubricant composition of claim 1, wherein the lubricating composition has a viscosity index greater than 200.

14. The lubricant composition of claim 1, wherein the base oil comprises between 2 and 10 weight % naphthenic carbon, between 90 and 98 weight % paraffinic carbon, and less than 1 weight % aromatic carbon by n-d-M with normalization.

15. The lubricant composition of claim 1, wherein the lubricant composition comprises less than 20 weight % DI additive package.

16. A process for forming a lubricant composition, the process comprising:

a) obtaining a base oil comprising a consecutive number of carbon atoms and greater than 10 weight % and less than 70 weight % cycloparaffins, wherein the cycloparaffins have a ratio of monocycloparaffins to multicycloparaffins of greater than 15, and having a viscosity index greater than a Viscosity Index Factor calculated by the following equation:

$$28 \times Ln(\text{Kinematic Viscosity at } 100^\circ \text{ C.}) + 95; \text{ and}$$

b) mixing the base oil with greater than 15 weight % DI additive package and less than 7 weight % VI improver;

wherein the lubricant composition has:

a traction coefficient less than 0.023 when measured at a kinematic viscosity of 15 $mm^2/s$ and a slide to roll ratio of 40%;

a dynamic viscosity at −35° C. of less than 6200 mPa·s;

an MRV at −40° C. of less than 60,000 mPa·s; and a CCS Viscosity at −35° C. of less than 6200 mPa·s.

17. The process of claim 16, further comprising hydroisomerization dewaxing a highly paraffinic feed using a shape selective intermediate pore size molecular sieve catalyst to derive the base oil.

18. The lubricant composition of claim 1, wherein the base oil has a viscosity index greater than 150.

19. The lubricant composition of claim 1, wherein the base oil has a ratio of monocycloparaffins to multicycloparaffins of greater than 20.

20. The lubricant composition of claim 1, wherein the lubricant composition is a diesel engine lubricant.

* * * * *

UNITED STATES PATENT AND TRADEMARK OFFICE

CERTIFICATE OF CORRECTION

PATENT NO. : 7,956,018 B2
APPLICATION NO. : 12/000183
DATED : June 7, 2011
INVENTOR(S) : James A. McGeehan It is certified that error appears in the above-identified patent and that said Letters Patent is hereby corrected as shown below:

Column 20, line 60:

"multiocycloparaf-" should read "multicycloparaf-"

Column 21, line 3:

"1 $mm^2/s$" should read "15 $mm^2/s$"

Signed and Sealed this
Fourth Day of October, 2011

David J. Kappos
*Director of the United States Patent and Trademark Office*